US006277808B1

(12) United States Patent
Tcheou et al.

(10) Patent No.: US 6,277,808 B1
(45) Date of Patent: Aug. 21, 2001

(54) COMPOSITION FOR TREATING STAINS ON LAUNDRY ITEMS AND METHOD OF TREATMENT

(75) Inventors: Eric Tcheou, Brussels; Jose Luis Vega, Strombeek-Bever, both of (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/068,572

(22) PCT Filed: Sep. 16, 1996

(86) PCT No.: PCT/US96/14766

§ 371 Date: May 27, 1998

§ 102(e) Date: May 27, 1998

(87) PCT Pub. No.: WO97/20094

PCT Pub. Date: Jun. 5, 1997

(30) Foreign Application Priority Data

Nov. 27, 1995 (EP) ..... 95118617

(51) Int. Cl.[7] ..... C11D 1/86; C11D 3/13; C11D 3/43

(52) U.S. Cl. ..... 510/417; 510/281; 510/283; 510/284; 510/505; 510/506; 134/42; 15/209.1

(58) Field of Search ..... 510/376, 312, 510/306, 310, 475, 305, 321, 372, 313, 444, 417, 281, 283, 284, 505, 506; 252/186.38, 186.39, 186.42; 8/137; 134/42; 15/209.1

(56) References Cited

U.S. PATENT DOCUMENTS 3,910,848 * 10/1975 Froehlich et al. ..... 252/90
4,176,080 * 11/1979 Wise et al. .
4,199,482 4/1980 Renaud et al. ..... 252/559
4,412,934 11/1983 Chung et al. ..... 252/186.38
4,472,291 * 9/1984 Rosano ..... 252/186.28
4,595,527 * 6/1986 Gipps ..... 252/546
4,606,840 * 8/1986 Gautier et al. ..... 252/171
4,634,551 1/1987 Burns et al. ..... 252/102
4,915,854 4/1990 Mao et al. ..... 252/545
4,954,286 * 9/1990 Sepulveda et al. ..... 252/174.22
5,205,960 4/1993 Kristopeit et al. ..... 252/174.24
5,435,936 * 7/1995 Broze ..... 252/162
5,490,948 * 2/1996 Klier et al. ..... 252/122
5,534,200 * 7/1996 Erilli et al. ..... 510/396
5,536,450 * 7/1996 Masters et al. ..... 510/417
5,538,662 * 7/1996 Klier et al. ..... 252/122
5,549,840 * 8/1996 Mondin ..... 510/365
5,616,548 * 4/1997 Thomas et al. ..... 510/242
5,691,289 * 11/1997 Purcell et al. ..... 510/174
5,891,836 * 4/1999 Kacher ..... 510/237

FOREIGN PATENT DOCUMENTS 1 518 676 7/1978 (GB) ..... C11D/10/02

* cited by examiner

*Primary Examiner*—Yogendra N. Gupta
*Assistant Examiner*—Gregory E. Webb
(74) *Attorney, Agent, or Firm*—C. Brant Cook; Kim William Zerby; Steven W. Miller

(57) ABSTRACT

A cleaning composition which is an oil-in-water or water-in-oil emulsion is disclosed. The composition includes (i) a non-aqueous hydrophobic solvent; (ii) a first anionic or nonionic surfactant having an alkyl chain, the length of the alkyl chain being $C_{11}$ or less; (iii) a second anionic or nonionic surfactant having an alkyl chain, the length of the alkyl chain being $C_{12}$ or more; and (iv) the pH of the cleaning composition being at least 8. Methods for using the cleaning composition for treating spots or stains on textile fabrics and laundry kits comprising the cleaning composition are also disclosed.

16 Claims, No Drawings

COMPOSITION FOR TREATING STAINS ON LAUNDRY ITEMS AND METHOD OF TREATMENT

The present invention relates to compositions for treating stains on laundry items. Laundry items can be treated either before or after a conventional laundering process by application of the composition in the region of the stain so that the stain is at least partially released and removal of the stain is made easier.

Emulsions of solvent-aqueous systems are known to be effective as spot pretreating compositions on both hydrophobic and hydrophilic stains.

GB-A-2 194 547, published on March 9, 1988, discloses mixtures of n-dodecane with both short-chain (Neodol 91-6) and long chain (Neodol 45-1) nonionics. The compositions are in the form of liquid solutions; water-in-oil or oil-in-water microemulsions, or gels. However this application does not disclose compositions which comprise alkali material. U.S. Pat. No. 4,093,418, issued on Jun. 6, 1978, and U.S. Pat. No. 4,178, 262, issued on Dec. 11, 1979, disclose isoparaffin ($C_{11}$–$C_{14}$) in combination with long-chain ($C_{10}$–$C_{18}$) nonionics.

The present invention relates to a cleaning composition which is an-oil-in-water or water-in-oil emulsion or a solution comprising non-aqueous hydrophobic solvent; first anionic or nonionic surfactant having an alkyl chain, the length of the alkyl chain being $C_{11}$ or less; and second anionic or nonionic surfactant having an alkyl chain, the length of the alkyl chain being $C_{12}$ or more.

It is the objective of the present invention to improve the cleaning performance of stain treatment compositions particularly on fatty or greasy stains, including cosmetics and food stains such as cream, milk, sauces. Another object of the present invention is to improve the removal of bleachable stains through the application of the composition of the present invention and the application of a bleaching compound, preferably a peroxide compound.

SUMMARY OF THE INVENTION

The objective of the present invention is achieved by providing a cleaning composition which has a pH greater than 8, thereby enhancing cleaning performance for both fatty stains and bleachable stains. Preferably the pH is greater than 9, and more preferably greater than 10.

The cleaning composition preferably comprises water from 5% to 95% by weight of the composition.

The invention also relates to a method for treating a spot or stain on a textile fabric using the cleaning compositions of the invention.

DETAILED DESCRIPTION OF THE INVENTION

Hydrophobic solvents are an essential feature of the compostions of the present invention. Preferred hydrophobic solvents are defined in terms of Hansen parameters. A hydrophobic solvent as defined herein is considered to be a solvent having Hansen hydrogen bonding cohesion parameter dH below 18 $(\text{Joule/cm}^3)^{0.5}$. Preferred hydrophobic solvents have a Hansen hydrogen bonding cohesion parameter dH below 12 $(\text{Joule/cm}^3)^{0.5}$ and a Hansen polar parameter dP below 8 $(\text{Joule/cm}^3)^{0.5}$.

Preferred solvents for use comprise mixtures of hydrocarbons with a flash point no lower than 70° C., an initial boiling point no lower than 130° C., preferably no lower than 145° C., and a solidification point not above 20° C. and aliphatic fatty acid esters. More preferred solvents would be alkanes or alkenes with a chain length above C7, and particularly alkanes and alkenes with an average of C8 to C20 atoms. Particularly preferred hydrophobic solvents are deodorised kerosine; solvent naphta; chlorinated hydrocarbons; and terpenes. Even more preferred are paraffins; isoparaffins; naphthenes; aromatics; olefins; 1,1,1-trichloroethane perchloroethylene; methylene chloride; Shellsol SS® mixture (C8–C11 isoparaffin+5% aliphatic C7 ester); D-Limonene; and Glidsafe® supplied by Glidsol. Solvents are used in the detergent compositions of the present invention preferably at a level of from 3% to 90%, more preferably from 4% to 45%, and most preferably from 5% to 25% by weight of the detergent composition.

Other solvents having a Hansen parameter of dH less than 18 $(\text{Joule/cm}^3)^{0.5}$ include glycol ethers, more preferably glycol ethers based upon ethylene oxide, propylene oxide, or mixtures thereof. Particularly preferred are ethylene glycol monoethyl ether; Propylene glycol monomethyl ether; 2-butoxy ethanol; butyl diethylene glycol ether ethanol; butoxytriglycol; butylene glycol; hexylene glycol; and propyl propanol. Such solvents are used in combination with mixtures of short chain surfactants and long chain surfactants.

By "short-chain" what is meant herein is surfactants which comprise a $C_6$–$C_{11}$ alkyl chain as their hydrophobic portion. Such short-chain surfactants are accordingly those conventionally used in this field, but with a shorter alkyl chain, and can be of any type. Accordingly, suitable short chain surfactants for use herein include $C_6$–$C_{11}$ alkyl sulfates ($C_6$–$C_{11}SO_4$), alkyl ether sulfates ($C_6$–$C_{11}$ $(OCH_2CH_2)eSO_4$), alkyl sulfonates ($C_6$–$C_{11}SO_3$), alkyl succinates ($C_6$–$C_{11}OOCCH_2CH_2COOZ$), alkyl carboxylates ($C_6$–$C_{11}COOM$), alkyl ether carboxylates ($C_6$–$C_{11}$ $(OCH_2CH_2)eCOOM$), alkyl sarcosinates ($C_6$–$C_{11}CON(CH_3)R$), alkyl sulfo succinates ($C_6$–$C_{11}OOCCH(SO_3M)CH_2COOZ$), amine oxides ($C_6$–$C_{11}RR'NO$), glucose amides ($C_6$–$C_{11}CONR''X$), alkylpyrrolidones ($C_6$–$C_{11}(C_4H_6ON)$, alkylpolysaccharides ($C_6$–$C_{11}OGg$), alkyl alkoxylates ($C_6$–$C_{11}$ $(OCH_2CH_2)e(OCH_2CH_2CH_2)pOH$) and betaines ($C_6$–$C_{11}N+(CH_3)_2CH_2COO$—). In the formulae in brackets, e and p are independently from 0 to 20 and e+p>0, Z is M or R,M is H or any counterion such as those known in the art, including Na, K,Li, $NH_4$, amine, X is a polyhydroxyhydrocarbyl having a linear hydrocarbyl chain with at least 3 hydroxyls directly connected to the chain, or an alkoxylated derivative thereof, R, R' and R" are $C_1$–$C_5$ alkyl groups, possibly functionalized with hydroxyl groups, R and R' are preferably $C_1$–$C_3$, most preferably methyl, R" is preferably 2-hydroxyethyl or 2 hydroxypropyl, G is saccharide, preferably glucose, and g is of from 1.5 to 8. All these surfactants are well known in the art. A more complete disclosure of conventional glucose amides can be found for instance in WO 92-06154 and a more complete disclosure of conventional alkyl polysaccharides can be found for instance in U.S. Pat No. 4,536,319. The compositions according to the present invention may comprise any of the above surfactants alone, or any combination thereof.

Preferred short chain nonionic surfactants for use herein are alkyl alkoxylates according to the formula $C_6$–$C_{11}$ $(OCH_2CH_2)_e(OCH_2CH_2CH_2)_pOH$, where e and p representing respectively the degree of ethoxylation and propoxylation, are independently of from 0 to 20, and that e+p>0. Most preferred short chain nonionic surfactants for use herein are those where e and p are such that e+p is from 3 to 10, particularly those where p is 0 and e is 3 to 8. Also, most preferred short chain nonionic surfactants for use herein are those where said short chain is a hydrocarbon chain comprising from 7 to 11 carbon atoms. Said preferred short chain nonionic surfactants for use herein can be manufactured by the processes well known to the man skilled in the art, such as condensation of the corresponding alcohol and alkylene oxide, but such short chain surfactants are more conveniently commercially available for instance from Sidobre under the trade name Mergital® $C_4$ (C8EO4), from Kolb under the trade names Imbentin® AG/810/050 and AG/810/080 (respectively C8–10EO5 and C8–10EO8); from Shell under the trade name Dobanol 91-2.5 ($C_9$–$C_{11}$ EO2.5), Dobanol 91-6 ($C_9$–$C_{11}$ EO6), Dobanol 91-4-6; from Vista Chemicals Vista 1012-52, from EXXON Asopol 91-4.6.

Another preferred class of short chain nonionic surfactants are secondary alcohol ethoxylates according to the formula

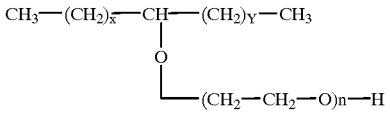

wherein (X+Y) is from 2 to 10 and the number of ethoxylate groups n is from 1 to 7. Example of commercially available surfactants of this type include the Tergitol S series from Union Carbide.

Preferred short chain anionic surfactants for use herein are $C_6$–$C_{11}$ alkyl sulfates and $C_6$–$C_{11}$ alkyl sulfonates, $C_6$–$C_{11}$ betaines, $C_6$–$C_{11}$amine oxides and mixtures thereof. Most preferred are the $C_6$–$C_8$ alkyl sulfates and sulfonates. Such short chain anionic surfactants can be made by well known sulphation or sulphonation processes followed by neutralization, but said anionic short chain surfactants are more conveniently commercially available, for instance from Rhone Poulenc under the trade name Rhodapon® OLS, or from Witco under the trade name Witconate®.

Any alkaline materials is suitable for use in the present invention. Preferred alkaline materials are selected from the group consisting of potassium hydroxide, sodium hydroxide, ammonium hydroxide, ammonium silicate, sodium bicarbonate, borax, monoethanolamine borate, monoethanolamine triethanolamine, and mixtures thereof. In general the spot treating composition comprises from 0.1% to 10%, preferably 0.5% to 3% by weight of the alkaline material. The pH is greater than 8, more preferably greater than 9, and most preferably greater than 10. pH of the neat compositions was measured by means of a portable pH meter from Knick (Portamess 752).

By "long-chain" what is meant herein is surfactants having an alkyl chain, the alkyl chain comprising 12, or more than 12 carbon atoms. Non-limiting examples of long-chain surfactants useful herein include the conventional $C_{12}$–$C_{18}$ alkyl benzene sulfonates ("LAS") and primary, branched-chain and random $C_{12}$–$C_{20}$ alkyl sulfates ("AS"), the $C_{12}$–$C_{18}$ secondary (2,3) alkyl sulfates of the formula $CH_3(CH_2)_x(CHOSO_3^-M^+)$ $CH_3$ and $CH_3$ $(CH_2)_y$ $(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{12}$–$C_{18}$ alkyl alkoxy sulfates ("$AE_xS$"; especially EO 1–7 ethoxy sulfates), $C_{12}$–$C_{18}$ alkyl alkoxy carboxylates (especially the EO 1–5 ethoxycarboxylates), the $C_{12-18}$ glycerol ethers, the $C_{12}$–$C_{18}$ alkyl polyglycosides and their corresponding sulfated polyglycosides the $C_{12}$–$C_{18}$ alpha-sulfonated fatty acid esters methyl ester sulphonate (MES), and oleyol sarcosinates. The conventional nonionic and amphoteric surfactants such as the $C_{12}$–$C_{18}$ alkyl ethoxylates ("AE") particulary preferred are $C_{12}$–$C_{16}$ fatty alcohol polyglycol ethers or ethoxylated primary alcohols with EO 2–7 (especially ethoxylates and mixed ethoxy/propoxy), $C_{12}$–$C_{18}$ betaines and sulfobetaines ("sultaines"), $C_{12}$–$C_{18}$ amine oxides, and the like, can also be included in the overall compositions. The $C_{12}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{12}$–$C_{18}$ N-(3-methoxypropyl) glucamide. The N-propyl through N-hexyl $C_{12}$–$C_{18}$ glucamides can be used for low sudsing. $C_{12}$–$C_{20}$ conventional soaps may also be used. If high sudsing is desired, the branched-chain $C_{12}$–$C_{16}$ soaps may be used. Mixtures of anionic and nonionic surfactants are espicially useful. Other conventional useful surfactants are listed in standard texts.

A particularly preferred composition according to the present invention comprises from 5% to 50% by weight of a mixed nonionic system comprising first, short-chain nonionic surfactant and second, long-chain nonionic surfactant. More preferably the composition comprises from 10% to 40% by weight of the mixed nonionic surfactant, and most preferably from 15% to 30%. The nonionic system preferably has an overall HLB value of from 2 to 16, more preferably from 8 to 14, most preferably from 9 to 10. Furthermore it is preferred that the ratio of first surfactant to second surfactant is from 1:10 to 10:1, more preferably from 1:3 to 3:1, and most preferably about 1:1.

Bleaching agents may also be useful in the method of the present invention for treating bleachable stains. The bleaching agents may be incorporated into the compositions described above, or may be added as separate bleaching compositions. Peroxide bleaching agents are most preferred.

The detergent composition of the present invention is useful in various known and conventional cleaning methods. However a preferred cleaning method comprises the steps of applying the detergent composition to the spot or stain; placing an absorbent layer adjacent to the textile fabric in the region of the spot or stain; and applying heat, pressure, or heat and pressure to the textile fabric in the region of the spot or stain; so that some or all of the spot or stain is absorbed into the absorbent layer. A still more preferred cleaning method comprises the steps of:

(a) applying the detergent composition to a spot or stain and placing an absorbent layer adjacent to the textile fabric in the region of the spot or stain and a first means for transferring some or all of the spot or stain into the absorbent layer; optionally also applying a peroxide bleaching agent and subsequently (b) applying a hydrophilic solvent or water, to the textile fabric in the region of the spot or stain and placing an absorbent layer adjacent to the textile fabric in the region of the spot or stain and the step of applying heat to the textile fabric in the region of the spot or stain. The application of heat or pressure, or both, may be achieved by any means, but is most preferably achieved by a hand-held device such as an iron. A conventional iron having a hot-plate fixed to a body is a highly preferred hand held device. The hot-plate is heated most commonly by electrical means, and may have a means for controlling the temperature. A supply of water or steam may also be provided by the iron. Most preferably the absorbent layer is placed on a flat surface, such as an ironing board, and the stained or soiled textile fabric is laid flat on top of, and in contact with, the absorbent layer. The iron can then be easily applied to the textile fabric in the region of the stain or spot in order to ensure complete, or substantially complete, transfer of the stain or spot into the absorbent layer. The iron is preferably operated at a temperature of from 40° C. to 200° C., more preferably from 40° C. to 180° C.

An alternative device for applying heat or pressure is a heated roller or any other heated applicator. The roller or applicator may also be provided with a supply of the detergent composition.

Suitable applicators include a steam iron with suction brush attachment, such as that disclosed in EP-A-0 493 348, and a thermoelectric applicator, such as that disclosed in EP-A-0 552 397. Also suitable is a steam iron with atomiser, such as that disclose in EP-A-0 629 736 wherein the detergent composition may optionally be stored in the iron and delivered directly onto the textile fabrics by means of the atomiser.

Without wishing to be bound by theory it is believed that hydrophobic stains are first rendered hydrophilic by applying a detergent composition, optionally with a gentle rubbing action. Greasy stains which contain hydroxyl groups are deprotoneated at high pH and are thus rendered more easy to solubilize in the detergent solution. Higher pH can also induce soil peptization on some food stains. The stains are in effect broken down, and rendered easier to remove. The benefits of high pH can be particularly observed when before or after application of the detergent composition, another composition containing a bleaching species is applied on the stain. Indeed, conventional peroxide bleaching technologies have an increased reactivity with pH. Water is then applied to the stain, again, optionally with a gentle rubbing action. The stain is removed by laying the stained fabric adjacent to an absorbent layer. The stain, which has been rendered more hydrophilic by the treatment, is transferred to the absorbent layer.

Textile fabrics are any materials made from cloth, including garments such as shirts, blouses, socks, skirts, trousers, jackets, underwear etc, and also including tablecloths, towels, curtains etc. The definition of textile fabrics as used herein does not include carpets and similar floor coverings.

Textile fabrics which are to be used in the present invention are commonly made by weaving or knitting. Many different fibres may be used to produce woven, knitted or other types of textile fabric including synthetic fibres (such as polyester, polyamide, etc.) and natural fibres from plants (such as cotton, hemp) and from animals (such as wool, angora, silk). Blends of different fibres are also commonly used.

EXAMPLES

| | Example 1 | Example 2 | Example 3 | Example 4 |
|---|---|---|---|---|
| Shellsol ® | 20 | 20 | 20 | 20 |
| Dobanol 25EO3 ® | 5 | 5 | 5 | — |
| Alkyl sulphate C8AS | 5 | — | 5 | 5 |
| Dehydol C8EO4 ® | — | 5 | — | 5 |
| Sodium hydroxide | 1 | 1 | — | — |
| Monoethanolamine | — | — | 3 | 3 |
| Water | 69 | 69 | 67 | 67 |

In the examples, Shellsol® is a mixture of $C_8$–$C_{11}$ isoparaffins with 5% aliphatic $C_7$ ester. Dehydol® is a fatty alcohol polyglycol ether octyl with an average of 4EO, supplied by Henkel. Dobanol® is a ethoxylated primary alcohol with an average of 3EO, supplied by Shell. Alkyl sulphate, $C_8$AS, has an average of 8 carbon atoms in the alkyl chain.

These emulsions were prepared by mixing the components in the following order : Dobanol 25E3 was first mixed with the Shellsol solvent. The short-chain surfactant (alkyl sulphate or Dehydol) was then added followed by an aqueous solution of sodium hydroxide. Mixing was continued until a stable oil-in-water emulsion was formed.

| | Example 5 | Example 6 | Example 7 |
|---|---|---|---|
| Limonene | 18.3 | 18.3 | 23.5 |
| HLAS | 10.5 | — | — |
| Dehydol C8EO4 ® | 6 | 16.5 | — |
| Alkyl Sulphate C8A5 | — | — | 7.8 |
| Monoethanolamine | 3 | 3 | 5.8 |
| Butyl carbitol | 10 | 10 | 11.7 |
| Oleic acid | — | — | 6 |
| Water | balance | balance | balance |

| | Example 8 | Example 9 | Example 10 | Example 11 |
|---|---|---|---|---|
| Dodecane | 22 | 48.2 | — | — |
| Hexadecane | — | — | 10 | — |
| Tridecane | — | — | — | 20 |
| C14-15EO1 | 5.5 | 14.8 | 10 | — |
| C12-15EO3 | — | — | — | 5 |
| C9-11EO6 | 22 | 34.2 | 7.5 | — |
| C8EO4 | — | — | | 5 |
| Sodium hydroxide | 1 | 1 | 1 | 1 |
| Butyl carbitol | — | 0.8 | — | — |
| Water | balance | balance | balance | balance |

In example 11, the tridecane was replaced by Isopar K® which is a $C_{10}$–$C_{12}$ isoparaffinic hydrocarbon from Exxon Glidsol 66-2 which is a mixture of terpene hydrocarbon from Glidoc Glidsol 100 which is a mixture of terpene hydrocarbon from Glidoc Invert 2000 which is a citrus terpene/water emulsion from Dow

| | Example 12 | Example 13 |
|---|---|---|
| Shellsol | 20 | 20 |
| Dobanol 25-3 (C12EO3) | 0.2 | 5.2 |
| C8 Alkyl sulphate | 5 | 5 |
| C10 Alkyl sulphate | 0.2 | 0.2 |
| Dehydol 04 (C8EO4) | 5 | — |
| Sodium hydroxide | 0.3 | 0.3 |
| DTPMP | 0.04 | 0.04 |
| Dobanol 90 | 0.3 | 0.3 |
| Hydrogen peroxide | 1.4 | 1.4 |
| Water | balance pH = 9 | balance pH = 9 |

DTPMP is diethylene triamine penta methylene phosphonic acid from Monsanto, Dequest 2060.

A set of polycotton swatches (50 mm square) were soiled with make-up, chocolate sauce and tomato sauce. The stain was left to age for a day, in the dark, at normal room temperature (c.a. 20° C., 60% RH). Each soiled swatch was cleaned by the following method: 1. The stained area was placed directly upon a strip of absorbent paper (the paper used was the absorbent core of a diaper). 2. 1 ml of the composition of Example 1 was dripped on to the stained area. 3. The stained area was brushed with a conventional electrical toothbrush for 10 seconds (the toothbrush used, a Braun® dental d3, was one normally intended for daily oral care). 4. The steps 2. and 3. were repeated one more time. 5. 1 ml of distilled water was dripped on to the stained area, and pressure and heat were applied using an iron set at a temperature of 120° C. for 10 seconds. A typical ironing pressure, as normally used for removing wrinkles in fabrics, was used. 6. Step 5. was repeated with a further 2 ml of distilled water. 7. The swatch was dried and smoothed.

The method of cleaning was repeated on stained swatches using the compositions of Examples 2 to 13 in place of the composition of Example 1.

What is claimed is:

1. A cleaning composition which is an oil-in-water or water-in-oil emulsion comprising:

(i) a non-aqueous hydrophobic solvent wherein the solvent comprises one or more hydrocarbons with a flash point of not less than 70° C.;

(ii) a first anionic or nonionic surfactant having an alkyl chain, the length of the alkyl chain being $C_{11}$ or less;

(iii) a second anionic or nonionic surfactant having an alkyl chain, the length of the alkyl chain being $C_{12}$ or more; and (iv) wherein the pH of the cleaning composition is at least 8.

2. A cleaning composition according to claim 1 comprising from 0.1 to 10% by weight of an alkaline material, wherein the alkaline material is selected from the group consisting of potassium hydroxide, sodium hydroxide, ammonium hydroxide, ammonium silicate, sodium bicarbonate, borax, monoethanolamine borate, monoethanolamine, triethanolamine, and mixtures thereof.

3. A cleaning composition according to claim 1 further comprising from 5 to 95% by weight of water.

4. A cleaning composition according to claim 1 comprising from 3% to 90% by weight of the non-aqueous hydrophobic solvent having a Hansen hydrogen bonding cohesion parameter dH below 18 $(\text{Joule/cm}^3)^{0.5}$ and a Hansen polar parameter dP below 8 $(\text{Joule/cm}^3)^{0.5}$.

5. A cleaning composition according to claim 4 wherein the solvent comprises hydrocarbons with an initial boiling point of greater than 145° C., and a solidification point of less than 20° C.

6. A cleaning composition according to claim 5 wherein the solvent is selected from the group consisting of $C_{10}$–$C_{18}$ linear or branched alkanes, terpene or mixtures thereof.

7. A cleaning composition according to claim 1 wherein the second surfactant is selected from the group consisting of $C_{12}$–$C_{16}$ fatty alcohol polyglycol ethers or ethoxylated primary alcohols with 2 to 7 ethoxylation.

8. A cleaning composition according to claim 7 comprising from 5% to 50% by weight of a mixed nonionic surfactant system comprising the first and second surfactants, the mixed nonionic surfactant system having an overall HLB value of from 2 to 16.

9. A cleaning composition according to claim 8 wherein the molar ratio of first surfactant to second surfactant is from 1:10 to 10:1.

10. A cleaning composition according to claim 1 wherein the pH of the cleaning composition at 1% solution in distilled water is at least 9.

11. A cleaning composition according to claim 1 wherein the pH of the cleaning composition at 1% solution in distilled water is at least 10.

12. A method of treating a spot or stain on a textile fabric comprising the steps of:

i) applying the cleaning composition according to claim 1 to the spot or stain;

ii) placing an absorbent layer adjacent to the textile fabric in the region of the spot or stain; and iii) applying a first means for transferring some or all of the spot or stain into the absorbent layer to the textile fabric in the region of the spot or stain, so that some or all of the spot or stain is absorbed into the absorbent layer.

13. A method according to claim 12 wherein the first means for transferring is selected from the group consisting of heat, pressure and mixtures thereof.

14. A method according to claim 12 wherein the method further comprises the subsequent steps of:

iv) applying a hydrophilic solvent, or water, to the textile fabric in the region of the spot or stain and placing an absorbent layer adjacent to the textile fabric in the region of the spot or stain; and v) applying a second means for transferring some or all of the spot or stain into the absorbent layer.

15. A method according to claim 14 wherein the second means for transferring comprises applying heat to the textile fabric in the region of the spot or stain using a hand-held iron.

16. A laundry kit for treating a spot or stain on a textile fabric comprising:

a) a cleaning composition according to claim 1; and b) one or more absorbent layers capable of absorbing some or all of the spot or stain when the one or more absorbent layers are placed adjacent to the textile fabric in the region of the spot or stain during the application of the cleaning composition to the spot or stain.

* * * * *